US008059857B2

(12) United States Patent
Sugiura

(10) Patent No.: US 8,059,857 B2
(45) Date of Patent: Nov. 15, 2011

(54) VOICE COIL BOBBIN AND SPEAKER SYSTEM

(75) Inventor: Hideaki Sugiura, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1285 days.

(21) Appl. No.: 11/716,041

(22) Filed: Mar. 9, 2007

(65) Prior Publication Data

US 2007/0223775 A1 Sep. 27, 2007

(30) Foreign Application Priority Data

Mar. 9, 2006 (JP) ..... 2006-064068

(51) Int. Cl.
*H04R 1/02* (2006.01)
*H04R 9/06* (2006.01)
*H04R 11/02* (2006.01)

(52) U.S. Cl. ..... 381/400; 381/407

(58) Field of Classification Search ..... 381/400, 381/403–405, 398, 407, 423, 424, 432; 181/166, 181/171, 172

See application file for complete search history.

(56) References Cited

U.S. PATENT DOCUMENTS

2005/0185818 A1 8/2005 Ishigaki et al.

FOREIGN PATENT DOCUMENTS

| | | | |
|---|---|---|---|
| JP | 54-102118 | A | 8/1979 |
| JP | 55-77297 | A | 6/1980 |
| JP | 57-014280 | | 1/1982 |
| JP | 60-87600 | A | 5/1985 |
| JP | 61-70491 | U | 5/1986 |
| JP | 64-60100 | A | 3/1989 |
| JP | 9-187098 | A | 7/1997 |
| JP | 11-150793 | A | 6/1999 |
| JP | 2005-277561 | | 10/2005 |

*Primary Examiner* — Tuan Nguyen
(74) *Attorney, Agent, or Firm* — Arent Fox LLP

(57) ABSTRACT

A voice coil bobbin, which transmits a motive force from the voice coil wound around the bobbin to a diaphragm, includes a main part, a reinforcement part formed on the surface side of the main part, and a middle part formed between the main part and the reinforcement part and made of a material which has a lower density than the other two parts, preferably a non-woven cloth. Thus, there can be provided with the simple-design, high-rigidity voice coil bobbin with high internal loss and a speaker system capable of high-quality sound reproduction.

11 Claims, 7 Drawing Sheets

A :PHENOLIC RESIN-IMPREGNATED GLASS CLOTH
B :POLYIMIDE RESIN-IMPREGNATED GLASS CLOTH
C : ARAMID NON-WOVEN CLOTH

VOICE COIL BOBBIN AND SPEAKER SYSTEM

BACKGROUND OF THE INVENTION

The present invention relates to a voice coil bobbin and a speaker system.

Electric/acoustic conversion devices such as microphones and speakers are well known. One example of such devices which convert electrical signals into acoustic signals is a commonly known speaker system with a cone-shaped diaphragm (see, for example, Japanese Patent Application Laid-Open Publication No. 2005-277561).

This speaker system includes an annular magnetic circuit made up of a plate, a magnet, and a yoke, and arranged at the lower end of an annular speaker frame. High-density magnetic flux is formed in the magnetic gap between the yoke and the plate of the magnetic circuit. A voice coil is wound around a tubular voice coil bobbin such that it can vibrate along the axial direction. The front side edge of this voice coil bobbin is secured to the center hole of the cone-shaped diaphragm, and the outer periphery of the diaphragm is secured to the speaker frame via a surround.

The voice coil bobbin is required to be able to transmit a motive force which is generated in the voice coil by the input of an audio signal precisely to the cone-shaped diaphragm. Accordingly, it is required to be lightweight for high efficiency transmission, and to have a high specific modulus of elasticity so that it can prevent deformation which may be caused by the vibration, and high internal loss so that it can attenuate unwanted vibration. Paper has been commonly used as the material which satisfies these requirements because paper is low in density and has appropriate rigidity, and also it is inexpensive. Other materials have also been used, such as foils of metals (e.g. aluminum or duralumin), or resin films (e.g. polyimide).

In high power speakers, a relatively large drive current is inputted to the voice coil to generate a large motive force, and therefore the voice coil bobbin is required to have high rigidity, and also high internal loss to attenuate unwanted vibration in the high frequency range. However, these physical properties are sometimes contradictory and cannot be achieved at the same time depending on the material of the bobbin, and if the voice coil bobbin is made of a single material, it is technically difficult to satisfy both of these requirements.

SUMMARY OF THE INVENTION

It is an object of the present invention to solve these problems and to provide a simple-design, high-rigidity voice coil bobbin with high internal loss, and a speaker system which can reproduce high-quality sound.

To achieve the above object, one aspect of the present invention is a voice coil bobbin which transmits a motive force from a voice coil wound around the bobbin to a speaker diaphragm, including a main body, a reinforcement layer formed on a surface side of the main body, and a middle layer formed between the main body and the reinforcement layer and made of a material which has a lower density than the main body and the reinforcement layer.

Another aspect of the present invention is a speaker system in which a voice coil is wound around a voice coil bobbin and positioned in a magnetic gap of a magnetic circuit, and a motive force from the voice coil is transmitted to a speaker diaphragm, the voice coil bobbin including a main body, a reinforcement layer formed on a surface side of the main body, and a middle layer formed between the main body and the reinforcement layer and made of a material which has a lower density than the main body and the reinforcement layer.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

A speaker system according to one embodiment of the present invention includes a voice coil bobbin for transmitting a motive force from the voice coil wound around the bobbin to a speaker diaphragm. The voice coil is arranged in a magnetic gap of a magnetic circuit. The outer peripheral edge of the diaphragm is supported by, for example, a speaker frame. The voice coil bobbin includes a main body, a reinforcement layer on the surface side of the main body, and a middle layer formed between them and made of a material which has a lower density than the reinforcement layer and the main body.

Preferably, the middle layer includes a non-woven cloth made of an organic material. Also, the middle layer should preferably have a smaller specific modulus of elasticity than the main body and the reinforcement layer. Furthermore, the middle layer should preferably have a higher internal loss than the main body and the reinforcement layer. Preferably, the middle layer includes a non-woven cloth made of an aramid organic material.

As the voice coil bobbin of this speaker system has a triple-layer structure with the main body, middle layer, and reinforcement layer with the middle layer being made of a material which has a lower density than the reinforcement layer and the main body, for example an organic non-woven cloth, the voice coil bobbin has high rigidity and high internal loss due to its enhanced structural strength. Thereby, the speaker system incorporating this voice coil bobbin is capable of reproducing high-quality sound.

One specific example of the voice coil bobbin and the speaker system including the bobbin of the present invention will be hereinafter described in detail with reference to the drawings.

Figure 1:
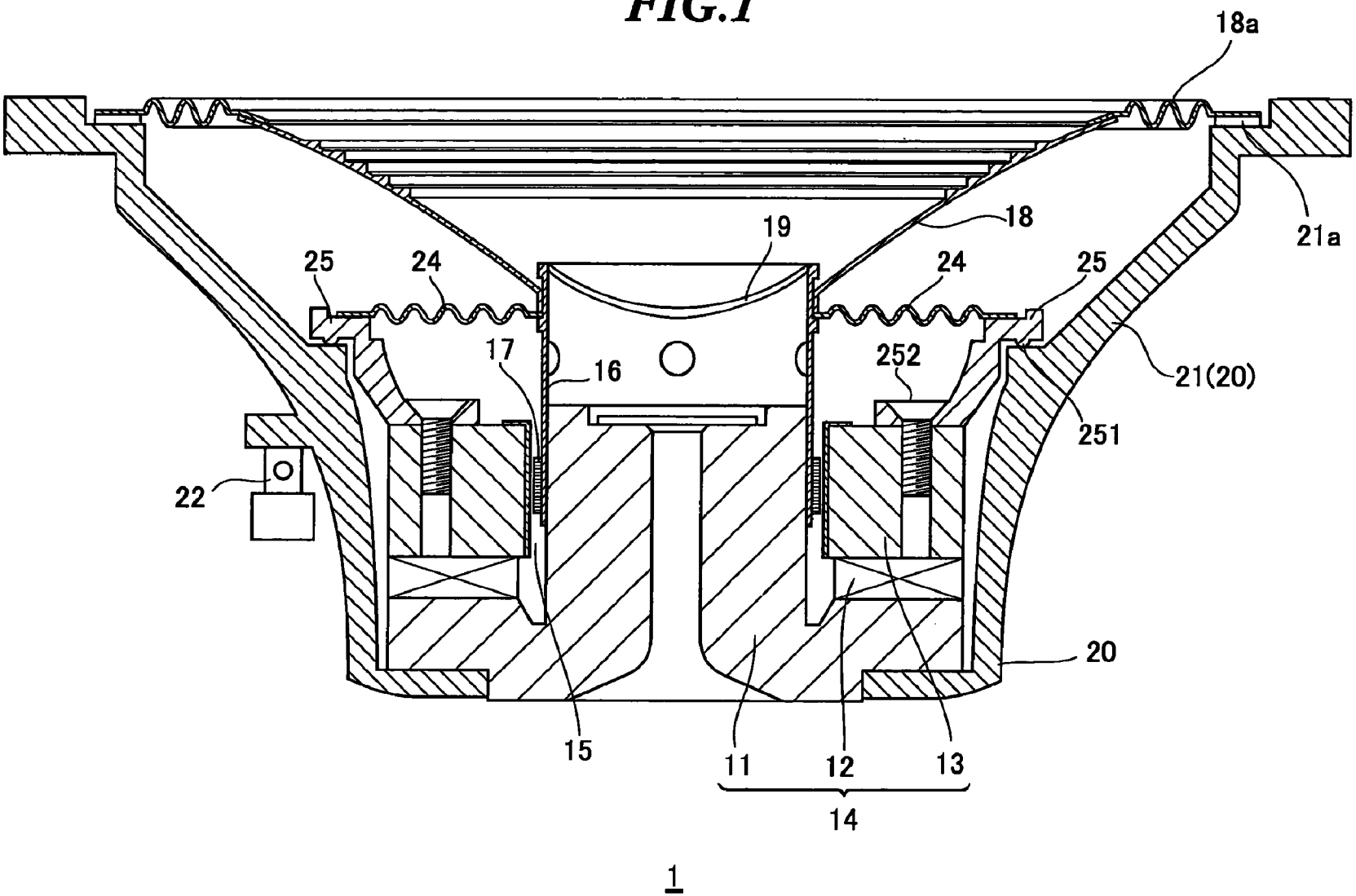
FIG. 1 is a cross sectional view of a speaker system according to one embodiment of the present invention.
Figure 2:
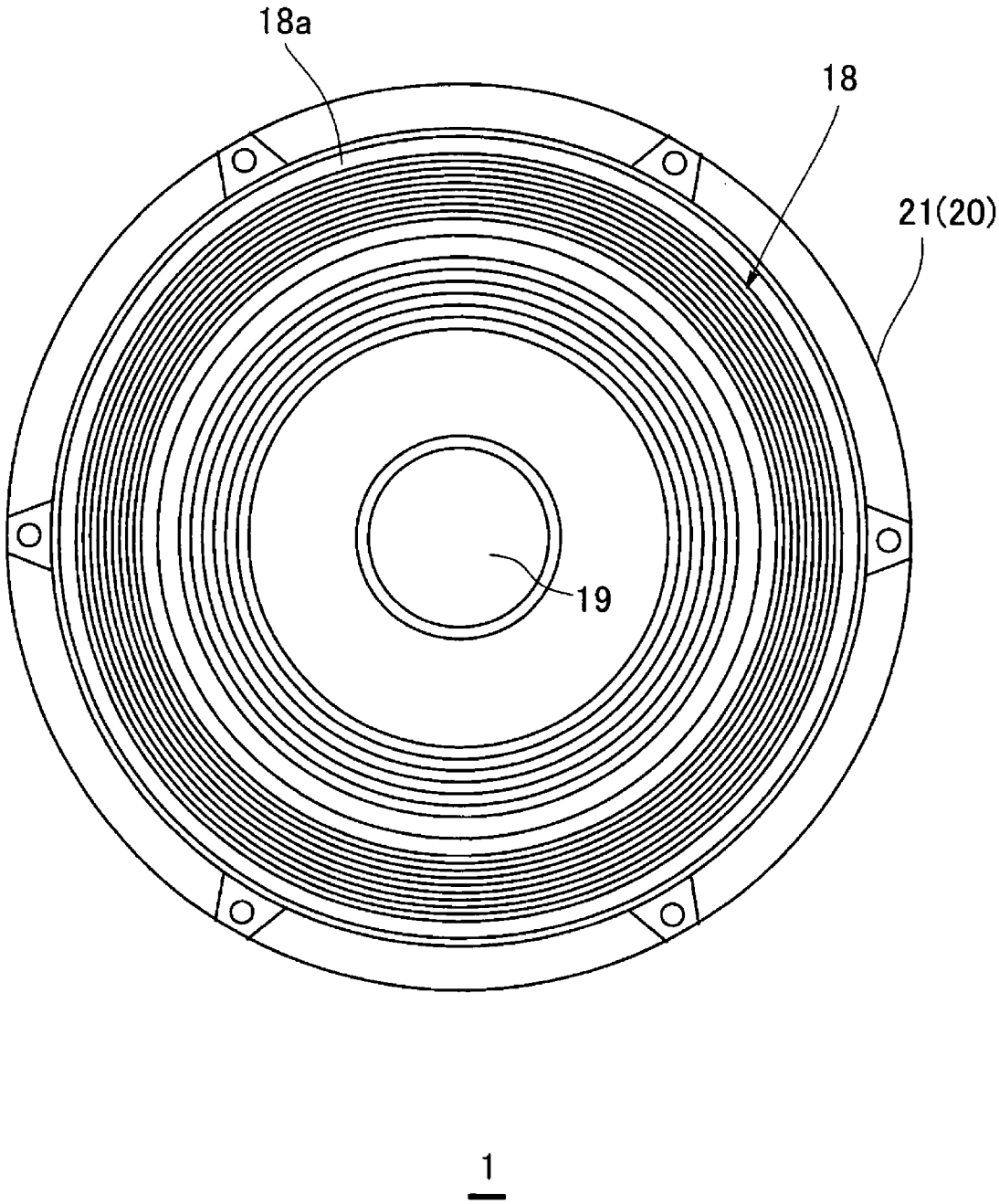
FIG. 2 is a front view of the speaker system of FIG. 1.
Figure 3:
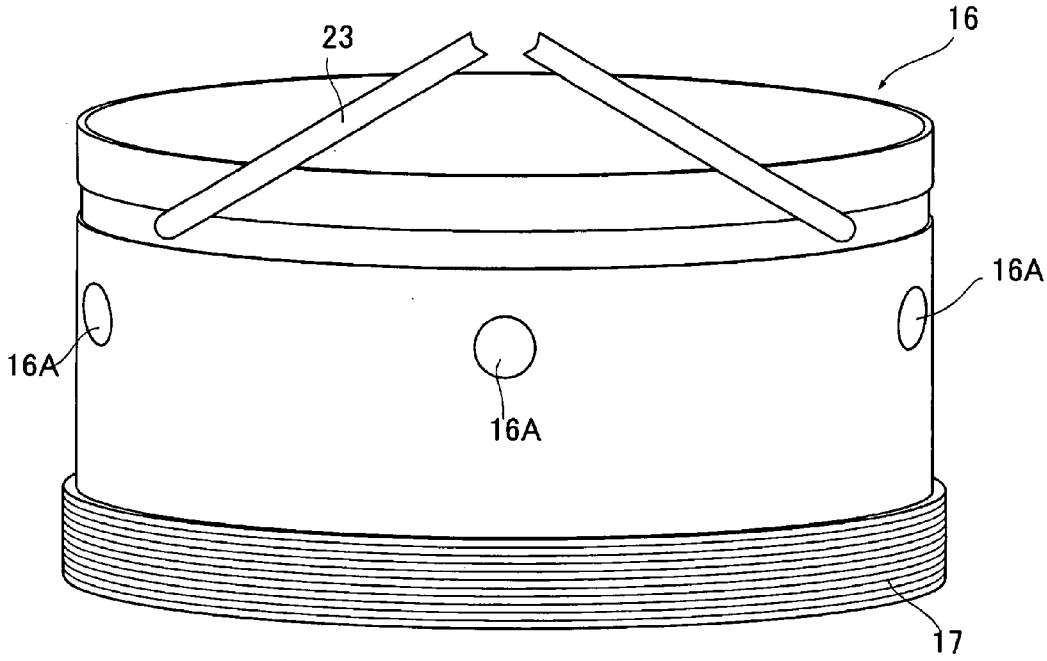
FIG. 3 is a perspective view of the voice coil in the speaker system of FIG. 1.

FIG. 1 is a cross sectional view of a speaker system according to one embodiment of the invention. FIG. 2 is a front view of the speaker system of FIG. 1. FIG. 3 is a perspective view of the voice coil in the speaker system of FIG. 1.

This speaker system 1 of the embodiment includes a magnetic circuit 14 made up of a yoke 11, a magnet 12, and a plate 13. In particular, as shown in FIG. 1, the yoke 11 is positioned in the center, the ring-like magnet 12 is arranged around the yoke 11, and the ring-like plate 13 is arranged upon the magnet 12. A magnetic gap 15 is formed between the outer circumference of the yoke 11 and the inner circumference of the ring-like magnet 12. The magnet 12 can either be a permanent magnet or an electromagnet.

A voice coil 17 is wound around a voice coil bobbin 16 and positioned in the magnetic gap 15 such that it can vibrate in the axial direction. Near the upper end of the voice coil bobbin 16 is attached to the center hole of a substantially conical speaker diaphragm (diaphragm) 18. A cap 19 is provided on an upper end of the voice coil bobbin 16 or near the center of the diaphragm 18. The voice coil bobbin 16 includes one or more apertures 16A which are provided for controlling the pressure inside the cap 19 and the voice coil bobbin 16 and for ensuring smooth movement of the bobbin 16.

The side and the back of the magnetic circuit 14 are supported by a frame 20. The frame 20 includes a plurality of arms 21 radially extending from near the side of the magnetic circuit 14 toward the front. A speaker terminal 22 is attached halfway on one of the arms 21. The voice coil 17 is electrically connected to the speaker terminal 22 through a lead wire 23 as shown in FIG. 3. Also halfway on the arms 21 is formed an annular damper holder (support holder) 25. A damper 24 is provided between this damper holder 25 and the voice coil bobbin 16 so as to support the bobbin 16 precisely in position in the magnetic gap 15. The damper 24 is elastic so that it can smoothly follow the vibration of the voice coil bobbin 16 along the axial direction. The outer peripheral edge of the cone-shaped diaphragm 18 is supported on the distal ends 21*a* of the arms 21 of the frame 20 via a surround 18*a* such that the diaphragm can vibrate. The damper holder 25 is secured to the plate 13 with fixing members such as bolts 252. The damper holder 25 makes contact with the frame 20 at projections 251 which can be formed preferably at three or more equally spaced locations on either one or both of the damper holder 25 and the frame 20. This connection structure using the projections 251 induces relative movements between the damper 24 and the frame 20 in reverse phases and thereby attenuates unwanted resonances in the midrange.

An input of a signal current from the speaker terminal 22 through the lead wire 23 to the voice coil 17 generates a magnetic force, which, together with the action of the magnetic circuit 14, causes the voice coil bobbin 16 to vibrate in the axial direction. Thus the diaphragm 18 vibrates back and forth and produces sound as a longitudinal wave which travels through gases or liquids.

Figure 4:
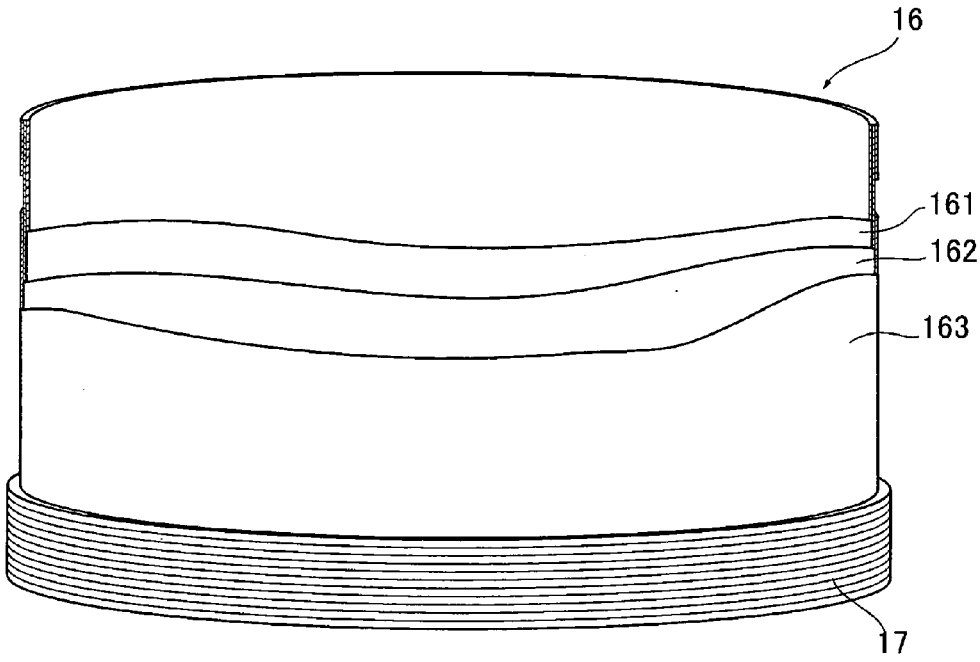
FIG. 4 is a partially cut view of the voice coil bobbin of FIG. 3 given in explanation of its multi-layer structure.
Figure 5A:
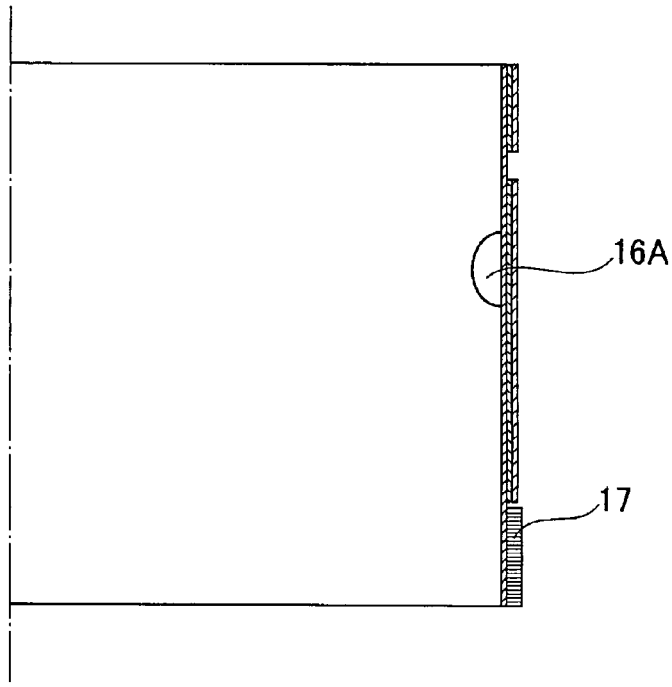
FIG. 5A is a cross sectional view of the voice coil bobbin of FIG. 3.
Figure 5B:
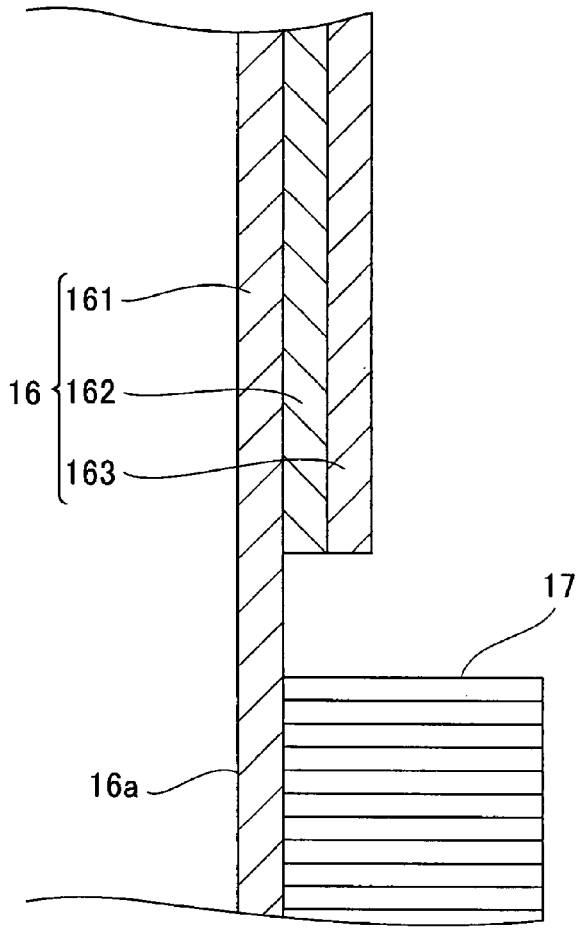
FIG. 5B is a cross sectional view of the bobbin illustrating its multi-layer structure.

Next, the voice coil bobbin 16 and the voice coil 17 will be described in more detail. FIG. 4 is a partially cut view of the voice coil bobbin of FIG. 3 given in explanation of its multi-layer structure. FIG. 5A is a cross sectional view of the voice coil bobbin of FIG. 3, and FIG. 5B is a cross sectional view of the bobbin illustrating its multi-layer structure.

The voice coil bobbin 16 is formed cylindrical to have a generally circular or oval cross section. The voice coil bobbin 16 according to this embodiment includes a main body (main part) 161, a middle layer (middle part) 162, and a reinforcement layer (reinforcement part) 163 as shown in FIG. 3 to FIG. 5B. The main part 161 has the reinforcement part 163 on a surface side thereof, and the middle part 162 which contains non-woven cloth is interposed between the main part 161 and the reinforcement part 163.

The examples of materials for the main part 161 include organic fiber, inorganic fiber, and metal. More specifically, the main part 161 of the bobbin may be made of any of glass fiber impregnated with a resin such as a phenolic or polyimide resin, foil of metal such as aluminum or duralumin, and film of resin such as polyimide.

The examples of materials for the reinforcement part 163 include organic fiber, inorganic fiber, and metal. More specifically, the reinforcement part 163 of the bobbin may be made of any of glass fiber impregnated with a resin such as a phenolic or polyimide resin, foil of metal such as aluminum or duralumin, and film of resin such as polyimide.

The middle part 162 is made of a material which has a lower density than the reinforcement part 163 and the main part 161. The material should preferably have a smaller specific modulus of elasticity than one or both of the main part 161 and the reinforcement part 163. Furthermore, the material should preferably have a higher internal loss than one or both of the main part 161 and the reinforcement part 163. This embodiment uses a non-woven cloth made of an organic material such as aramid fiber for the middle part 162. Aramid is a strong and highly elastic aromatic polyamide fiber. Alternatively, the middle part 162 may be made of an inorganic non-woven cloth.

The voice coil bobbin 16 of this embodiment has a triple-layer structure consisting of the main part 161, middle part 162, and reinforcement part 163, with a core part 16*a* and the voice coil 17 wound around the core part at the lower end as shown in FIG. 5B. Namely, as shown, the bobbin 16 has a single-layer structure made of the main part 161 only in the core part 16*a* at the lower end, where the voice coil 17 is wound around.

Figure 6:
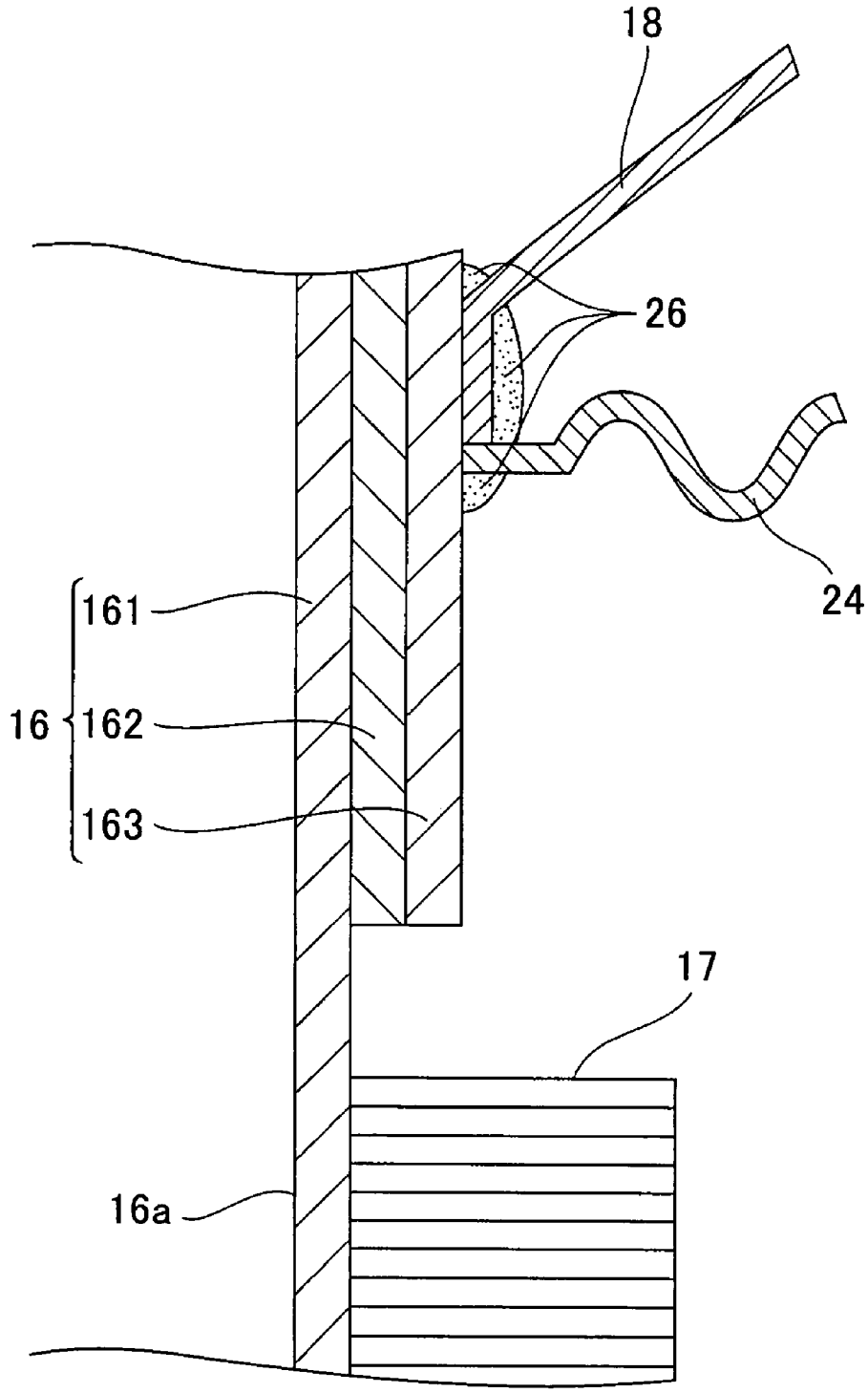
FIG. 6 is an enlarged cross sectional view of the voice coil bobbin and its vicinity in the speaker system of FIG. 1.

FIG. 6 is an enlarged cross sectional view of the voice coil bobbin and its vicinity in the speaker system 1 of FIG. 1. In this embodiment, the inner peripheral edge of the diaphragm 18 is secured using an adhesive 26 to the reinforcement part 163 which is formed on the middle part 162 of the bobbin. The inner peripheral edge of the damper 24 is also secured to the reinforcement part 163 using an adhesive 26.

Since the voice coil bobbin 16 includes the main body (main part) 161, the middle layer (middle part) 162, and the reinforcement layer (reinforcement part) 163 provided on the surface side of the main part 161, with the middle part 162 being formed between the main part 161 and the reinforcement part 163 and made of a material which has a lower density than the other two parts, such as an organic non-woven cloth, the voice coil bobbin 16 has high rigidity and internal loss due to its enhanced structural strength.

This voice coil bobbin 16 is produced, for example, by heat and pressure molding with the middle part 162 of aramid non-woven cloth and the reinforcement part 163 of polyimide resin-impregnated glass fiber laminated upon the tubular main part 161 which is pre-formed from phenolic resin-impregnated glass fiber.

An input of a signal current from the speaker terminal 22 through the lead wire 23 to the voice coil 17 generates a magnetic force in the coil 17, which, together with the action of the magnetic circuit 14, drives the voice coil bobbin 16 to vibrate in the axial direction. This motive force is transmitted from the main part 161, at which the bobbin 16 is secured, through the middle part 162 and the reinforcement part 163 to the diaphragm 18 and vibrates the diaphragm 18. As the motive force is thus transmitted through the middle part 162, unwanted vibration is reduced.

[Comparison]

The inventor of the present invention has measured the acoustic properties such as internal loss and specific modulus of elasticity of the voice coil bobbin 16 according to one embodiment of the present invention which has the triple-layer structure of the main part 161, middle part 162, and reinforcement part 163, and of various other voice coil bobbins for comparison, to compare the respective performances of the bobbins 16.

TABLE 1

| | | MATERIAL THICKNESS | DENSITY ρ | YOUNG'S MODULUS E [N/m²] | | INTERNAL LOSS | | SPECIFIC MODULUS OF ELASTICITY E/ρ [m²/s²] | | E/ρ² | |
|---|---|---|---|---|---|---|---|---|---|---|---|
| | | t [mm] | [kg/m²] | 100 Hz | 1000 Hz | 100 Hz | 1000 Hz | 100 Hz | 1000 Hz | 100 Hz | 1000 Hz |
| COMPARATIVE EXAMPLE 1 | A | 0.18 | 1450 | 6.92E+09 | 7.05E+09 | 0.0157 | 0.0145 | 4.77E+06 | 4.86E+06 | 3.29E+03 | 3.35E+03 |
| COMPARATIVE EXAMPLE 2 | B | 0.19 | 1460 | 5.79E+09 | 6.07E+09 | 0.0167 | 0.0157 | 3.97E+06 | 4.16E+06 | 2.72E+03 | 2.85E+03 |
| COMPARATIVE EXAMPLE 3 | C | 0.18 | 710 | 7.35E+08 | 9.31E+08 | 0.2009 | 0.1567 | 1.04E+06 | 1.31E+06 | 1.46E+03 | 1.85E+03 |
| EXAMPLE OF THE PRESENT INVENTION | A + C + B | 0.53 | 1270 | 8.28E+09 | 9.11E+09 | 0.1018 | 0.0740 | 6.52E+06 | 7.17E+06 | 5.13E+03 | 5.65E+03 |
| COMPARATIVE EXAMPLE 4 | A + B + C | 0.53 | 1250 | 6.92E+09 | 5.57E+09 | 0.0761 | 0.0589 | 5.54E+06 | 4.46E+06 | 4.43E+03 | 3.56E+03 |
| COMPARATIVE EXAMPLE 5 | A + B | 0.38 | 1420 | 5.16E+09 | 8.14E+09 | 0.0340 | 0.0263 | 3.63E+06 | 5.57E+06 | 2.56E+03 | 4.04E+03 |
| COMPARATIVE EXAMPLE 6 | A + C | 0.36 | 1080 | 3.70E+09 | 4.22E+09 | 0.1045 | 0.0835 | 3.43E+06 | 3.91E+06 | 3.17E+03 | 3.62E+03 |
| COMPARATIVE EXAMPLE 7 | C + B | 0.36 | 1120 | 3.40E+09 | 3.81E+09 | 0.0976 | 0.0820 | 3.04E+06 | 3.40E+06 | 2.71E+03 | 3.04E+03 |

Figure 7A:
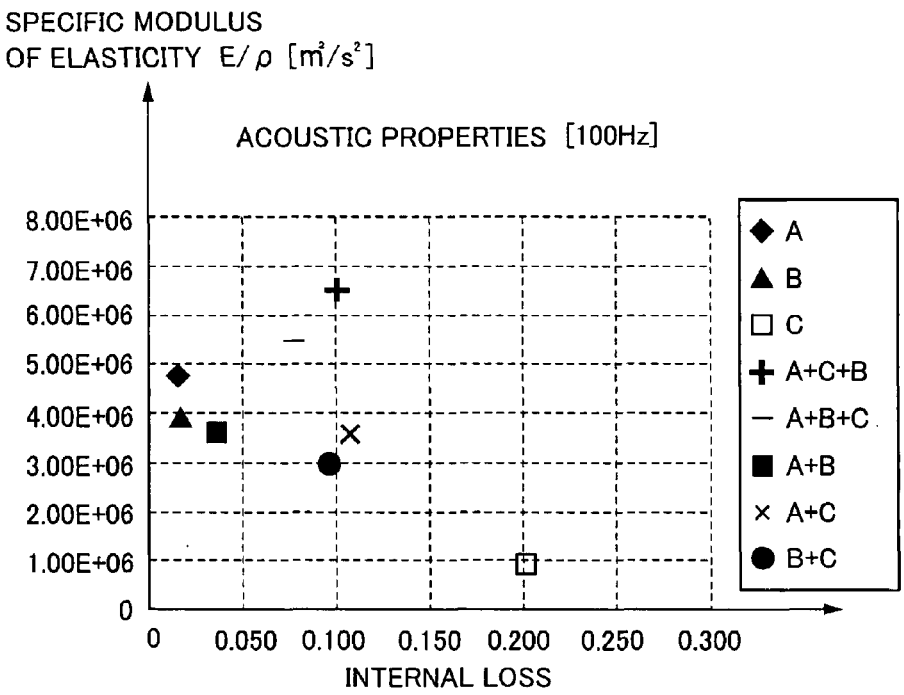
FIG. 7A and FIG. 7B are graphs showing the physical properties of the voice coil bobbin according to one embodiment of the invention and of various other examples, in particular the relationship between the internal loss and the specific modulus of elasticity, when reproducing a 100 Hz and a 1000 Hz audio signal, respectively.
Figure 7B:
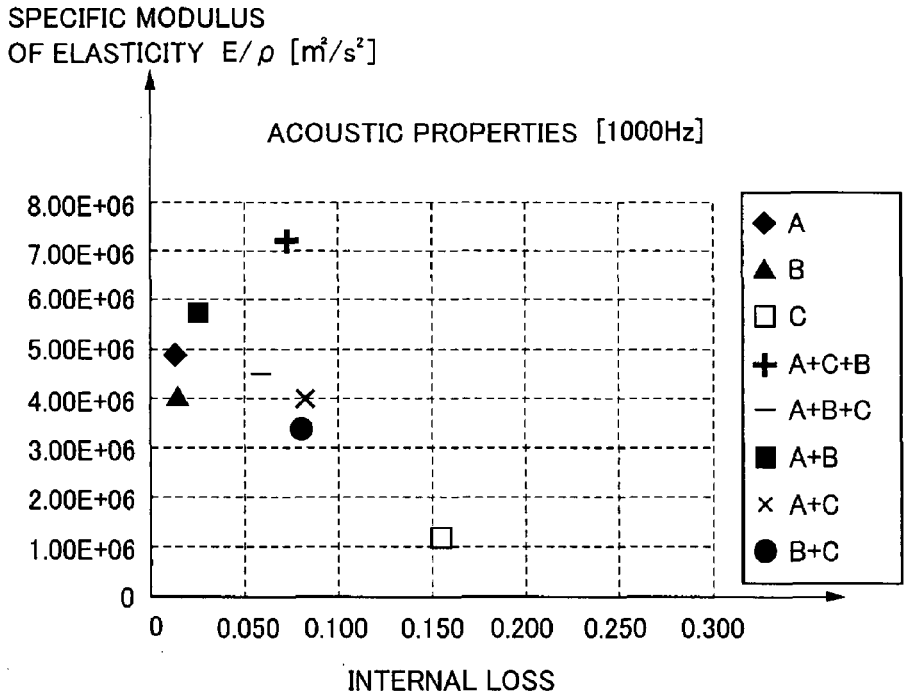

For the comparison, voice coil bobbins made of either one or a combination of A) phenolic resin-impregnated glass fiber, B) polyimide resin-impregnated glass fiber, and C) aramid non-woven cloth were produced, and their various properties were measured. The results are shown in Table 1. FIG. 7A and FIG. 7B are graphs illustrating the results shown in Table 1. In these graphs, the horizontal axis represents the internal loss and the vertical axis represents the specific modulus of elasticity (E/ρ [m²/s²]).

Figure 8A:
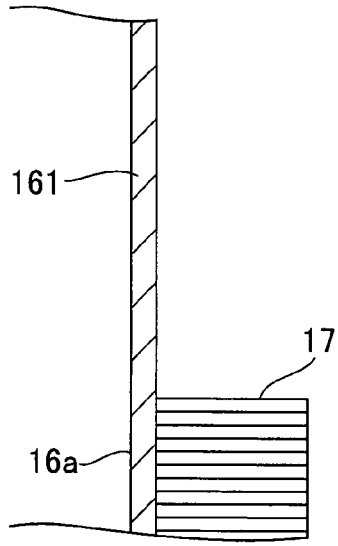
FIG. 8A to FIG. 8C are enlarged cross sectional views of voice coil bobbins with a single-, a double-, and a triple-layer structure, respectively.

Comparative example 1 is a single-layer voice coil bobbin shown in FIG. 8A made of phenolic resin-impregnated glass fiber (A). Comparative example 2 is a single-layer voice coil bobbin shown in FIG. 8A made of polyimide resin-impregnated glass fiber (B). Comparative example 3 is a single-layer voice coil bobbin shown in FIG. 8A made of aramid non-woven cloth (C).

Figure 8B:
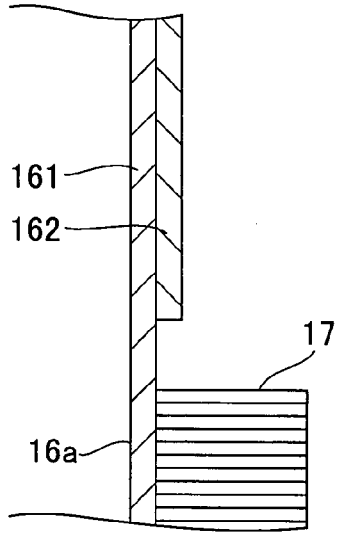
Figure 8C:
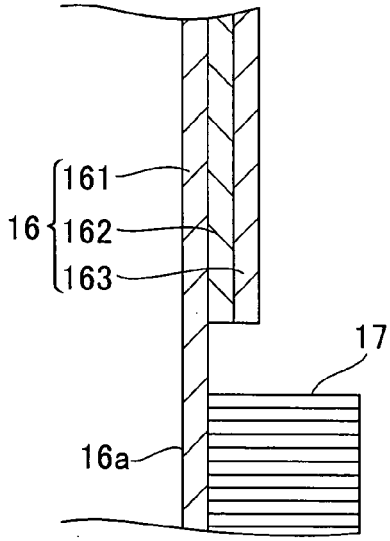

The voice coil bobbin 16 of the present invention is a triple-layer bobbin shown in FIG. 8C, including the main part 161 made of phenolic resin-impregnated glass fiber (A), the middle part 162 made of aramid non-woven cloth (C), and the reinforcement part 163 made of polyimide resin-impregnated glass fiber (B).

Comparative example 4 is a triple-layer bobbin shown in FIG. 8C, including the main part 161 made of phenolic resin-impregnated glass fiber (A), the middle part 162 made of polyimide resin-impregnated glass fiber (B), and the reinforcement part 163 made of aramid non-woven cloth (C).

Comparative example 5 is a double-layer bobbin shown in FIG. 8B, including the main part 161 made of phenolic resin-impregnated glass fiber (A), and the reinforcement part 163 made of polyimide resin-impregnated glass fiber (B).

Comparative example 6 is a double-layer bobbin shown in FIG. 8B, including the main part 161 made of phenolic resin-impregnated glass fiber (A) and aramid non-woven cloth (C) provided around the main part.

Comparative example 7 is a double-layer bobbin shown in FIG. 8B, including the main part 161 made of polyimide resin-impregnated glass fiber (B), and the reinforcement part 163 made of aramid non-woven cloth (C).

In the triple-layer structure of the voice coil bobbin 16 of the present invention, the middle part 162 is made of aramid non-woven cloth (C), which has an internal loss of about ten times larger than that of the phenolic or polyimide resin-impregnated glass fiber (A) or (B) of the main part 161 and the reinforcement part 163, and which has a specific modulus of elasticity of about four to five times smaller than that of the glass fibers (A) and (B). Therefore, the voice coil bobbin 16 exhibited higher internal loss and specific modulus of elasticity as compared to the voice coil bobbins of Comparative examples 1 and 2, which are made of a single material of either (A) or (B).

Also the results showed that the voice coil bobbin 16 of the present invention has higher specific modulus of elasticity and substantially equal internal loss as compared to the double-layer voice coil bobbins of comparative examples 5 to 7.

Furthermore, the results showed that the voice coil bobbin 16 of the present invention has higher internal loss and specific modulus of elasticity as compared to the triple-layer voice coil bobbin of Comparative example 4.

The upper right region of the graphs shown in FIG. 7A and FIG. 7B represents high specific modulus of elasticity and high internal loss of the bobbin material. As can be seen, the voice coil bobbin 16 of the present invention, which has the triple-layer structure of the main part 161 made of phenolic resin-impregnated glass fiber (A), middle part 162 made of aramid non-woven cloth (C), and reinforcement part 163 made of polyimide resin-impregnated glass fiber (B), exhibited better properties than the other examples which are made of a single material or a combination of two materials.

The present invention is obviously not limited to the above example of the embodiment. Other combinations of materials as noted in the description of the embodiment of the invention are possible. Also, the dome-shaped diaphragm of the invention can be applied to other electronic/acoustic conversion devices such as microphones.

While the embodiment described above uses a magnetic circuit with an internal magnet structure, an external magnet structure can also be adopted.

Various other shapes can be adopted for the diaphragm 18, such as a curved cone, a flat cone, a parabolic cone, an oval cone, a circular cone, and the like. The diaphragm 18 used in the embodiment described above has a corrugation on a surface thereof, but this is not an absolute requirement.

As described above, the voice coil bobbin 16 of the invention is a bobbin which transmits a motive force from the voice coil wound around the bobbin to the speaker diaphragm, including a main part (main body) 161, a reinforcement part (reinforcement layer) 163 provided on the surface side of the main part, and a middle part (middle layer) 162 sandwiched between them and made of a material which has a lower density than the other two parts. Thus a simple-design, high-rigidity voice coil bobbin with high internal loss is obtained.

With the middle part (middle layer) 162 being formed of an organic non-woven cloth, a simple-design, high-rigidity voice coil bobbin with high internal loss can be produced.

With this voice coil bobbin 16 being adopted in a speaker system, in which the voice coil 17 is wound around the bobbin 16 and positioned in the magnetic gap 15 of the magnetic circuit 14, and a motive force from the voice coil 17 is transmitted to the diaphragm 18, high-quality sound reproduction is made possible.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A voice coil bobbin which transmits a motive force to a speaker diaphragm, comprising:

a cylindrical main body;

a voice coil wound around a first region which is a part of an outer circumference of said main body;

a reinforcement layer formed on a second region of said outer circumference of said main body, said second region being different from said first region; and a middle layer formed between said main body and said reinforcement layer.

2. The voice coil bobbin according to claim 1, wherein said middle layer is formed by a non-woven cloth made of an aramid organic material which has a lower density than said main body and said reinforcement layer.

3. The voice coil bobbin according to claim 1, wherein said main body includes a material selected from a group consisting of organic fiber, inorganic fiber, and metal.

4. The voice coil bobbin according to claim 1, wherein said reinforcement layer includes a material selected from a group consisting of organic fiber, inorganic fiber, and metal.

5. The voice coil bobbin according to claim 1, wherein an inner peripheral part of said speaker diaphragm is secured to the reinforcement layer formed on said middle layer of said voice coil bobbin.

6. The voice coil bobbin according to claim 1, wherein said main body includes a glass fiber impregnated with a phenolic resin, and said reinforcement layer includes a glass fiber impregnated with a polyimide resin.

7. The voice coil bobbin according to claim 1, wherein said main body, said reinforcement layer, and said middle layer are each formed by a different material.

8. The voice coil bobbin according to claim 1, wherein an outer diameter of said voice coil wound around said main body is larger than an outer diameter of said reinforcement layer formed on said main body.

9. The voice coil bobbin according to claim 1, wherein said outer circumference of said main body includes a third region which is different from said first region and said second region.

10. The voice coil bobbin according to claim 1, wherein a surface area of said second region is greater than a surface area of said first region.

11. A speaker system in which a voice voil is wound around a voice coil bobbin and positioned in a magnetic gap of a magnetic circuit, and a motive force from said voice coil is transmitted to a speaker diaphragm, wherein the voice coil bobbin includes:

a main body;

a voice coil wound around a first region which is a part of an outer circumference of said main body;

a reinforcement layer formed on a second region of said outer circumference of said main body, said second region being different from said first region; and a middle layer formed between said main body and said reinforcement layer, and wherein said middle layer being is formed by a non-woven cloth made of an aramid organic material which has a lower density than said main body and said reinforcement layer.

* * * * *